US005531938A

United States Patent [19]

Erilli

[11] Patent Number: 5,531,938

[45] Date of Patent: Jul. 2, 1996

[54] MICROEMULSION LIGHT DUTY LIQUID CLEANING COMPOSITIONS

[75] Inventor: Rita Erilli, Liege, Belgium

[73] Assignee: Colgate-Palmolive Co., Piscataway, N.J.

[21] Appl. No.: 344,059

[22] Filed: Nov. 23, 1994

[51] Int. Cl.[6] ..... C11D 1/831; C11D 1/84

[52] U.S. Cl. ..... 510/417; 252/311; 510/235; 510/429; 510/432; 510/434; 510/470; 510/472; 510/506

[58] Field of Search ..... 252/546, 549, 252/550, 554, 555, 173, 174.21, DIG. 1, DIG. 14

[56] References Cited

U.S. PATENT DOCUMENTS 5,075,026 12/1991 Loth et al. ..... 252/122
5,076,954 12/1991 Loth et al. ..... 252/122
5,082,584 1/1992 Loth et al. ..... 252/122
5,108,643 4/1992 Loth et al. ..... 252/174.11
5,385,696 1/1995 Repinec et al. ..... 252/546
5,387,375 2/1995 Erilli et al. ..... 252/546
5,389,304 2/1995 Repinec et al. ..... 252/546
5,389,305 2/1995 Repinec et al. ..... 252/546

*Primary Examiner*—Paul Lieberman
*Assistant Examiner*—Necholus Ogden
*Attorney, Agent, or Firm*—Richard E. Nanfeldt; James M. Serafino

[57] ABSTRACT

A liquid duty liquid microemulsion composition comprises a mixture of a secondary alkane sulfonate surfactant, an alkyl ether polyethenoxy sulfate surfactant, an anionic biodegradable surfactant, a cosurfactant, a perfume or water insoluble hydrocarbon and water.

11 Claims, No Drawings

MICROEMULSION LIGHT DUTY LIQUID CLEANING COMPOSITIONS

This invention relates to an improved light duty liquid cleaner in the form of a microemulsion designed in particular for cleaning hard surfaces and which is effective in removing grease soil and/or kitchen soil and in leaving unrinsed surfaces with a shiny appearance.

BACKGROUND OF THE INVENTION

In recent years liquid detergents have become widely accepted for cleaning hard surfaces, e.g., painted woodwork and panels, tiled walls, wash bowls, bathtubs, linoleum or tile floors, washable wall paper, etc.. Such liquids comprise clear and opaque aqueous mixtures of water-soluble synthetic organic detergents and water-soluble detergent builder salts. In order to achieve comparable cleaning efficiency with granular or powdered all-purpose cleaning compositions, use of water-soluble inorganic phosphate builder salts was favored in the prior art all-purpose liquids. For example, such early phosphate-containing compositions are described in U.S. Pat. Nos. 2,560,839; 3,234,138; 3,350,319; and British Patent No. 1,223,739.

In view of the environmentalist's efforts to reduce phosphate levels in ground water, improved all-purpose liquids containing reduced concentrations of inorganic phosphate builder salts or non-phosphate builder salts have appeared. A particularly useful self-opacified liquid of the latter type is described in U.S. Pat. No. 4,244,840.

However, these prior art liquid detergents containing detergent builder salts or other equivalent tend to leave films, spots or streaks on cleaned unrinsed surfaces, particularly shiny surfaces. Thus, such liquids require thorough rinsing of the cleaned surfaces which is a time-consuming chore for the user.

In order to overcome the foregoing disadvantage of the prior art, U.S. Pat. No. 4,017,409 teaches that a mixture of paraffin sulfonate and a reduced concentration of inorganic phosphate builder salt should be employed. However, such compositions are not completely acceptable from an environmental point of view based upon the phosphate content. On the other hand, another alternative to achieving phosphate-free all-purpose liquids has been to use a major proportion of a mixture of anionic and nonionic detergents with minor amounts of glycol ether solvent and organic amine as shown in U.S. Pat. No. 3,935,130. Again, this approach has not been completely satisfactory and the high levels of organic detergents necessary to achieve cleaning cause foaming which, in turn, leads to the need for thorough rinsing which has been found to be undesirable to today's consumers.

Another approach to formulating hard surfaced liquid detergent composition where product homogeneity and clarity are important considerations involves the formation of oil-in-water (o/w) microemulsions which contain one or more surface-active detergent compounds, a water-immiscible solvent (typically a hydrocarbon solvent), water and a "cosurfactant" compound which provides product stability. By definition, an o/w microemulsion is a spontaneously forming colloidal dispersion of "oil" phase particles having a particle size in the range of about 25 to about 800 Å in a continuous aqueous phase. In view of the extremely fine particle size of the dispersed oil phase particles, microemulsions are transparent to light and are clear and usually highly stable against phase separation.

Patent disclosures relating to use of grease-removal solvents in o/w microemulsions include, for example, European Patent Applications EP 0137615 and EP 0137616—Herbors et al; European Patent Application EP 0160762—Johnston et al; and U.S. Pat. No. 4,561,991—Herbots et al. Each of these patent disclosures also teaches using at least 5% by weight of grease-removal solvent.

It also is known from British Patent Application GB 2144763A to Herbots et al, published Mar. 13, 1985, that magnesium salts enhance grease-removal performance of organic grease-removal solvents, such as the terpenes, in o/w microemulsion liquid detergent compositions. The compositions of this invention described by Herbots et al. require at least 5% of the mixture of grease-removal solvent and magnesium salt and preferably at least 5% of solvent (which may be a mixture of water-immiscible non-polar solvent with a sparingly soluble slightly polar solvent) and at least 0.1% magnesium salt.

However, since the amount of water immiscible and sparingly soluble components which can be present in an o/w microemulsion, with low total active ingredients without impairing the stability of the microemulsion is rather limited (for example, up to about 18% by weight of the aqueous phase), the presence of such high quantities of grease-removal solvent tend to reduce the total amount of greasy or oily soils which can be taken up by and into the microemulsion without causing phase separation. The following representative prior art patents also relate to liquid detergent cleaning compositions in the form of o/w microemulsions: U.S. Pat. Nos. 4,472,291—Rosario; 4,540,448—Gauteer et al; 3,723,330—Sheflin.

Liquid detergent compositions which include terpenes, such as d-limonene, or other grease-removal solvent, although not disclosed to be in the form of o/w microemulsions, are the subject matter of the following representative patent documents: European Patent Application 0080749; British Patent Specification 1,603,047; 4,414,128; and 4,540,505. For example, U.S. Pat. No. 4,414,128 broadly discloses an aqueous liquid detergent composition characterized by, by weight:

(a) from about 1% to about 20% of a synthetic anionic, nonionic, amphoteric or zwitterionic surfactant or mixture thereof;

(b) from about 0.5% to about 10% of a mono- or sesquiterpene or mixture thereof, at a weight ratio of (a):(b) lying in the range of 5:1 to 1:3; and (c) from about 0.5% about 10% of a polar solvent having a solubility in water at 15° C. in the range of from about 0.2% to about 10%. Other ingredients present in the formulations disclosed in this patent include from about 0.05% to about 2% by weight of an alkali metal, ammonium or alkanolammonium soap of a $C_{13}$–$C_{24}$ fatty acid; a calcium sequestrant from about 0.5% to about 13% by weight; non-aqueous solvent, e.g., alcohols and glycol ethers, up to about 10% by weight; and hydrotropes, e.g., urea, ethanolamines, salts of lower alkylaryl sulfonates, up to about 10% by weight. All of the formulations shown in the Examples of this patent include relatively large amounts of detergent builder salts which are detrimental to surface shine.

Furthermore, the present inventors have observed that in formulations containing grease-removal assisting magnesium compounds, the addition of minor amounts of builder salts, such as alkali metal polyphosphates, alkali metal carbonates, nitrilotriacetic acid salts, and so on, tends to make it more difficult to form stable microemulsion systems.

SUMMARY OF THE INVENTION

The present invention provides an improved, clear light duty liquid cleaning composition having improved interfacial tension which improves cleaning in the form of a microemulsion which is suitable for cleaning hard surfaces such as dishes, plastic, vitreous and metal surfaces having a shiny finish. The light duty liquid microemulsion compositions of the instant invention can be generally described as comprising approximately by weight:

(a) 10% to 34% of a mixture of a alkali metal salt of a $C_{13}$–$C_{17}$ secondary alkane sulfonate surfactant and an alkali metal salt of a $C_8$–$C_{18}$ alkyl polyethenoxy sulfate surfactant, wherein the ratio of sulfonate surfactant to the sulfate surfactant is about 1.2.:1 to about 14:1, more preferably about 1.35:1 to about 5:1

(b) About 1 to about 25% of a modified alkyl polyglucoside surfactant or an alkyl ethoxy citrate such as lauryl ethoxy citrate;

(c) 0.4% to 10.0%, more preferably 1.0% to 8.0% of a perfume, an essential oil or a water insoluble hydrocarbon;

(d) 0 to 25% of a cosurfactant, more preferably 2 to 15% of a cosurfactant;

(e) 0 to 25% of a zwitterionic surfactant such as a betaine; and (f) the balance being water, wherein the composition has a Brookfield viscosity at 25° C. at 30 rpms using a #2 spindle of about 20 to 500 cps, more preferably about 200 to 450 cps, a pH of about 5 to about 7, and a light transmission of at least about 95%, more preferably at about 98%.

DETAILED DESCRIPTION OF THE INVENTION

The present invention relates to a stable microemulsion composition approximately by weight: about 1% to about 25% of a modified polyglucoside surfactant or an alkyl ethoxy citrate, 10% to 34% of a mixture of secondary alkane sulfonate anionic surfactant and an alkyl ether polyethenoxysulfate surfactant. 0% to 25% of a cosurfactant, 0 to 25% of a zwitterionic surfactant such as betaine, 0.4% to 10% of a water insoluble hydrocarbon essential oil or a perfume and the balance being water, said composition having a light transmission of at least about 95%, more preferably at least about 98%.

According to the present invention, the role of the hydrocarbon is provided by a non-water-soluble perfume. Typically, in aqueous based compositions the presence of a solubilizers, such as alkali metal lower alkyl aryl sulfonate hydrotrope, triethanolamine, urea, etc., is required for perfume dissolution, especially at perfume levels of about 1% and higher, since perfumes are generally a mixture of fragrant essential oils and aromatic compounds which are generally not water-soluble. Therefore, by incorporating the perfume into the aqueous cleaning composition as the oil (hydrocarbon) phase of the ultimate o/w microemulsion composition, several different important advantages are achieved.

First, the cosmetic properties of the ultimate cleaning composition are improved: the compositions are both clear (as a consequence of the formation of a microemulsion) and highly fragranced (as a consequence of the perfume level).

Second, the need for use of solubilizers, which do not contribute to cleaning performance, is eliminated.

As used herein and in the appended claims the term "perfume" is used in its ordinary sense to refer to and include any non-water soluble fragrant substance or mixture of substances including natural (i.e., obtained by extraction of flower, herb, blossom or plant), artificial (i.e., mixture of natural oils or oil constituents) and synthetically produced substance) odoriferous substances. Typically, perfumes are complex mixtures of blends of various organic compounds such as alcohols, aldehydes, ethers, aromatic compounds and varying amounts of essential oils (e.g., terpenes) such as from about 0% to about 80%, usually from about 10% to 70% by weight, the essential oils themselves being volatile odoriferous compounds and also serving to dissolve the other components of the perfume.

In the present invention the precise composition of the perfume is of no particular consequence to cleaning performance so long as it meets the criteria of water immiscibility and having a pleasing odor. Naturally, of course, especially for cleaning compositions intended for use in the home, the perfume, as well as all other ingredients, should be cosmetically acceptable, i.e., non-toxic, hypoallergenic, etc.

The hydrocarbon such as a perfume is present in the dilute o/w microemulsion in an amount of from about 0.4% to about 10% by weight, preferably from about 1.0% to about 8% by weight, especially preferably from about 2% to about 7% by weight. If the amount of hydrocarbon (perfume) is less than about 0.4% by weight it becomes difficult to form the o/w microemulsion. If the hydrocarbon (perfume) is added in amounts more than about 10% by weight, the cost is increased without any additional cleaning benefit and, in fact, with some diminishing of cleaning performance insofar as the total amount of greasy or oily soil which can be taken up in the oil phase of the microemulsion will decrease proportionately.

Furthermore, although superior grease removal performance will be achieved for perfume compositions not containing any terpene solvents, it is apparently difficult for perfumers to formulate sufficiently inexpensive perfume compositions for products of this type (i.e., very cost sensitive consumer-type products) which includes less than about 20%, usually less than about 30%, of such terpene solvents.

Thus, merely as a practical matter, based on economic consideration, the dilute o/w microemulsion detergent cleaning compositions of the present invention may often include as much as about 0.2% to about 7% by weight, based on the total composition, of terpene solvents introduced thereunto via the perfume component. However, even when the amount of terpene solvent in the cleaning formulation is less than 1.5% by weight, such as up to about 0.6% by weight or 0.4% by weight or less, satisfactory grease removal and oil removal capacity is provided by the inventive diluted o/w microemulsions.

In place of the perfume one can employ an essential oil such as D-limonene or alpha-terpineol, a water insoluble paraffin or isoparaffin having about 6 to about 18 carbon at a concentration of about 0.4 to about 10 wt. percent, more preferably 0.4 to 8.0 wt. %.

Suitable water-soluble non-soap, anionic detergents include those surface-active or detergent compounds which contain an organic hydrophobic group containing generally 8 to 26 carbon atoms and preferably 10 to 18 carbon atoms in their molecular structure and at least one water-solubilizing group selected from the group of sulfonate, sulfate and carboxylate so as to form a water-soluble detergent. Usually, the hydrophobic group will include or comprise a $C_8$–$C_{22}$ alkyl, alkylaryl or acyl group. Such detergents are employed in the form of water-soluble salts and the salt-forming cation usually is selected from the group consisting of sodium, potassium, ammonium, magnesium and mono-, di- or tri-$C_2$–$C_3$ alkanolammonium, with the sodium, magnesium and ammonium cations again being preferred.

Examples of suitable sulfonated anionic detergents are the well known higher alkyl mononuclear aromatic sulfonates such as the higher alkyl benzene sulfonates containing from 10 to 16 carbon atoms in the higher alkyl group in a straight or branched chain, $C_8$–$C_{15}$ alkyl toluene sulfonates and $C_8$–$C_{15}$ alkyl phenol sulfonates.

A preferred sulfonate is linear alkyl benzene sulfonate having a high content of 3- (or higher) phenyl isomers and a correspondingly low content (well below 50%) of 2- (or lower) phenyl isomers, that is, wherein the benzene ring is preferably attached in large part at the 3 or higher (for example, 4, 5, 6 or 7) position of the alkyl group and the content of the isomers in which the benzene ring is attached in the 2 or 1 position is correspondingly low. Particularly preferred materials are set forth in U.S. Pat. No. 3,320,174.

Other suitable anionic detergents are the olefin sulfonates, including long-chain alkene sulfonates, long-chain hydroxyalkane sulfonates or mixtures of alkene sulfonates and hydroxyalkane sulfonates. These olefin sulfonate detergents may be prepared in a known manner by the reaction of sulfur trioxide ($SO_3$) with long-chain olefins containing 8 to 25, preferably 12 to 21 carbon atoms and having the formula $RCH{=}CHR_1$ where R is a higher alkyl group of 6 to 23 carbons and $R_1$ is an alkyl group of 1 to 17 carbons or hydrogen to form a mixture of suitones and alkene sulfonic acids which is then treated to convert the suitones to sulfonates. Preferred olefin sulfonates contain from 14 to 16 carbon atoms in the R alkyl group and are obtained by sulfonating an 2 olefin.

Other examples of suitable anionic sulfonate surfactants are the paraffin sulfonates containing about 10 to 20, preferably about 13 to 17, carbon atoms. Primary paraffin sulfonates are made by reacting long-chain alpha olefins and bisulfites and paraffin sulfonates having the sulfonate group distributed along the paraffin chain are shown in U.S. Pat. Nos.. 2,503,280; 2,507,088; 3,260,744; 3,372,188; and German Patent 735,096. The preferred anionic sulfonate surfactants used in the instant compositions are the $C_{13}$–$C_{17}$ secondary alkane sulfonate surfactants.

Examples of satisfactory anionic sulfate detergents are the $C_8$–$C_{18}$ alkyl sulfate salts and the $C_8$–$C_{18}$ alkyl ether polyethenoxy sulfate salts having the formula $R(OC_2H_4)n\ OSO_3M$ wherein n is 1 to 12, preferably 1 to 5, and M is a solubilizing cation selected from the group consisting of sodium, potassium, ammonium, magnesium and mono-, di- and triethanol ammonium ions. The alkyl sulfates may be obtained by sulfating the alcohols obtained by reducing glycerides of coconut oil or tallow or mixtures thereof and neutralizing the resultant product. On the other hand, the alkyl ether polyethenoxy sulfates are obtained by sulfating the condensation product of ethylene oxide with a $C_8$–$C_{18}$ alkanol and neutralizing the resultant product. The alkyl sulfates may be obtained by sulfating the alcohols obtained by reducing glycerides of coconut oil or tallow or mixtures thereof and neutralizing the resultant product. On the other hand, the alkyl ether polyethenoxy sulfates are obtained by sulfating the condensation product of ethylene oxide with a $C_8$–$C_{18}$ alkanol and neutralizing the resultant product. The alkyl ether polyethenoxy sulfates differ from one another in the number of moles of ethylene oxide reacted with one mole of alkanol. Preferred alkyl sulfates and preferred alkyl ether polyethenoxy sulfates contain 10 to 16 carbon atoms in the alkyl group.

The $C_8$–$C_{12}$ alkylphenyl ether polyethenoxy sulfates containing from 2 to 6 moles of ethylene oxide in the molecule also are suitable for use in the inventive compositions. These detergents can be prepared by reacting an alkyl phenol with 2 to 6 moles of ethylene oxide and sulfating and neutralizing the resultant ethoxylated alkylphenol.

Other suitable anionic detergents are the $C_9$–$C_{15}$ alkyl ether polyethenoxyl carboxylates having the structural formula $R{-}O(C_2H_4O)_nR1COOX$ wherein n is a number from 4 to 12, preferably 5 to 10 R1 is selected from the group consisting of $CH_2$ TO $C_3H_6$ and X=H+, Na+, K+, Li+, NH4+, DEA, TEA or other cations including multivalent. R is a fatty group from $C_8$ to $C_{18}$.

Obviously these anionic detergents will be present either in acid form or salt form depending upon the pH of the final composition, with salt forming cation being the same as for the other anionic detergents.

Of the foregoing non-soap anionic detergents, the preferred detergents are the $C_9$–$C_{15}$ linear alkylbenzene sulfonates and the $C_{13}$–$C_{17}$ paraffin or secondary alkane sulfonates. Particularly, preferred compounds are sodium $C_{10}$–$C_{13}$ alkylbenzene sulfonate and sodium $C_{13}$–$C_{17}$ secondary alkane sulfonate. Generally, the proportion of the nonsoap-anionic sulfonate detergent will be in the range of 1.0% to 25%, preferably from 1% to 7%, by weight of the dilute o/w microemulsion composition.

Generally, the proportion of the nonsoap-anionic alkyl ether polyethonoxy sulfate detergent will be in the range of 1% to 20%, preferably from 2% to 10%, by weight of the dilute o/w microemulsion composition, wherein the ratio of anionic sulfonate to the alkyl ether polyethenoxy sulfate is about 1.2:1 to about 14:1, more preferably about 1.3:1 to about 5:1.

The water-soluble zwitterionic surfactant, which is also an essential ingredient of present liquid detergent composition, constitutes about 0 to 25%, preferably 1% to 10%, by weight and provides good foaming properties and mildness to the present nonionic based liquid detergent. The zwitterionic surfactant is a water soluble betaine having the general formula:

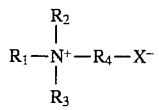

wherein $X^-$ is selected from the group consisting of $CO_2^-$ and $SO_3^-$ and $R_1$ is an alkyl group having 10 to about 20 carbon atoms, preferably 12 to 16 carbon atoms, or the amido radical $$R{-}CO{-}NH{-}(CH_2)_a{-}$$

wherein R is an alkyl group having about 9 to 19 carbon atoms and a is the integer 1 to 4; $R_2$ and $R_3$ are each alkyl groups having 1 to 3 carbons and preferably 1 carbon; $R_4$ is an alkylene or hydroxyalkylene group having from 1 to 4 carbon atoms and, optionally, one hydroxyl group. Typical alkyldimethyl betaines include decyl dimethyl betaine or 2-(N-decyl-N, N-dimethyl-ammonia) acetate, coco dimethyl betaine or 2-(N-coco N, N-dimethylammonio) acetate, myristyl dimethyl betaine, palmityl dimethyl betaine, lauryl dimethyl betaine, cetyl dimethyl betaine, stearyl dimethyl betaine, etc. The amidobetaines similarly include cocoamidoethylbetaine, cocoamidopropyl betaine and the like. A preferred betaine is coco ($C_8$–$C_{18}$) amidopropyl dimethyl betaine.

One of the biodegradable anionic surfactants useful in the instant invention is a sodium salt of a di-alcohol ethoxy citrate which is depicted by the formula:

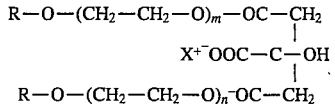

wherein R is an alkyl group of about 10 to about 16 carbon atoms. An especially preferred biodegradable anionic surfactant is a di-laureth citrate, sodium salt manufactured by Auschem wherein $X^+$ is selected from the group consisting of sodiu, potassium, ammonium, triethanol amine diethanoi amine and monoethanol amine, wherein sodium is preferred and m and n are each a number from 1 to 12, more preferably 5 to 9, most preferably 7.

Another biodegradable anionic surfactant is a modified alkyl polyglycoside depicted by the formula

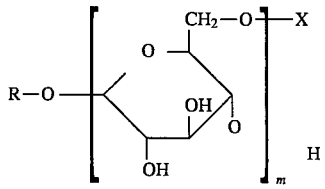

wherein R is a $C_{10}$ to $C_{16}$ alkyl group, m is a number average which is less than 4 and is of such a value to provide a number molecular weight of about 500 to 1000, preferably about 1 to about 4, and X is selected from the group consisting of

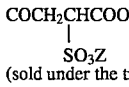

(sold under the tradename of Eucaro ™ APG/SS),

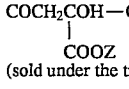

(sold under the tradename of Eucaro ™ APG/EC)

and

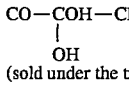

(sold under the tradename of Eucaro ™ APG/ET)

wherein Z is selected from the group consisting of sodium, potassium, ammonium, triethanol amine, diethanol amine and monoethanol amine. Euacarol is a trade name of Auschem The cosurfactant may play an essential role in the formation of the microemulsion compositions. Very briefly, in the absence of the cosurfactant the water, detergent(s) and hydrocarbon (e.g., perfume) will, when mixed in appropriate proportions form either a miceliar solution (low concentration) or form an oil-in-water emulsion in the first aspect of the invention. With the cosurfactant added to this system, the interfacial tension at the interface between the emulsion droplets and aqueous phase is reduced to a very low value (never negative). This reduction of the interfacial tension results in spontaneous break-up of the emulsion droplets to consecutively smaller aggregates until the state of a transparent colloidal sized emulsion. e.g., a microemulsion, is formed. In the state of a microemulsion, thermodynamic factors come into balance with varying degrees of stability related to the total free energy of the microemulsion. Some of the thermodynamic factors involved in determining the total free energy of the system are (1) particle-particle potential; (2)interfacial tension or free energy (stretching and bending); (3) droplet dispersion entropy; and (4) chemical potential changes upon formation. A thermodynamically stable system is achieved when (2) interfacial tension or free energy is minimized and (3) droplet dispersion entropy is maximized. Thus, the role of cosurfactant in formation of a stable o/w microemulsion is to (a) decrease interfacial tension (2); and (b) modify the microemulsion structure and increase the number of possible configurations (3). Also, the cosurfactant will (c) decrease the rigidity.

Generally, an increase in cosurfactant concentration results in a wider temperature range of the stability of the product.

The highly suitable cosurfactants of the instant composition over temperature ranges extending from 4° C. to 43° C. are water-soluble $C_2$–$C_4$ alkanols, polypropylene glycol of the formula $HO(CH_3CHCH_2O)_nH$ wherein n is a number from 1 to 18 and monoalkyl ethers and esters of ethylene glycol and propylene glycol having the structural formulas $R(X)_nOH$ and $R_1(X)_nOH$ wherein R is $C_1$–$C_6$ alkyl, $R_1$ is $C_2$–$C_4$ acyl group, X is $(OCH_2CH_2)$ or $(OCH_2CHCH_3)$ and n is a number from 1 to 4.

Representative members of the polypropylene glycol include dipropylene glycol and polypropylene glycol having a molecular weight of 200 to 1000, e.g., polypropylene glycol 400. Other satisfactory glycol ethers are ethylene glycol monobutyl ether (butyl cellosolve), diethylene glycol monobutyl ether (butyl carbitol), triethylene glycol monobutyl ether, mono, di, tri propylene glycol monobutyl ether, tetraethylene glycol monobutyl ether, propylene glycol tertiary butyl ether, ethylene glycol monoacetate and dipropylene glycol propionate.

While all of the aforementioned glycol ether compounds provide the described stability, the most preferred cosurfactant compounds of each type, on the basis of cost and cosmetic appearance (particularly odor), are glycerol, dipropylene glycol monomethyl ether and propylene glycol. Less preferred cosurfactants are ethanol, propanol isopropanol, butanol, isobutanol and alkanols having 5 to 7 carbon atoms.

The amount of cosurfactant required to stabilize the microemulsion compositions will, of course, depend on such factors as the surface tension characteristics of the cosurfactant, the type and amounts of the primary surfactants and perfumes, and the type and amounts of any other additional ingredients which may be present in the composition and which have an influence on the thermodynamic factors enumerated above. Generally, amounts of cosurfactant in the range of from 0% to 25%, preferably from about 0.5% to 15%, especially preferably from about 2% to 13%, by weight provide stable dilute o/w microemulsions for the above-described levels of primary surfactants and perfume and any other additional ingredients as described below.

The final essential ingredient in the inventive light duty liquid microemulsion compositions having improved interfacial tension properties is water. The proportion of water in the microemulsion compositions generally is in the range of 20% to 97%, preferably 70% to 97% by weight of the usual diluted o/w microemulsion composition.

As believed to have been made clear from the foregoing description, the light duty liquid microemulsion compositions of this invention are especially effective when used as is, that is, without further dilution in water, since the properties of the composition as a microemulsion are best manifested in the neat (undiluted) form. However, at the same time it should be understood that depending on the levels of surfactants, cosurfactants, perfume and other ingredients, some degree of dilution without disrupting the microemulsion, per se, is possible. For example, at the preferred low levels of active surfactant compounds dilutions up to about 50% will generally be well tolerated without causing phase separation, that is, the microemulsion state will be maintained.

However, even when diluted to a great extent, such as a 2- to 10-fold or more dilution, for example, the resulting compositions are still effective in cleaning greasy, oily and other types of soil. Furthermore, the presence of magnesium ions or other polyvalent ions, e.g., aluminum, as will be described in greater detail below further serves to boost cleaning performance of the primary detergents in dilute usage.

In addition to the above-described essential ingredients required for the formation of the microemulsion composition, the compositions of this invention may possibly contain one or more additional ingredients which serve to improve overall product performance.

One such ingredient is an inorganic or organic salt of oxide of a multivalent metal cation, particularly $Mg^{++}$. The metal salt or oxide provides several benefits including improved cleaning performance in dilute usage, particularly in soft water areas, and minimized amounts of perfume required to obtain the microemulsion state. Magnesium sulfate, either anhydrous or hydrated (e.g., heptahydrate), is especially preferred as the magnesium salt. Good results also have been obtained with magnesium oxide, magnesium chloride, magnesium acetate, magnesium propionate and magnesium hydroxide. These magnesium salts can be used with formulations at neutral or acidic pH since magnesium hydroxide will not precipitate at these pH levels.

Although magnesium is the preferred multivalent metal from which the salts (inclusive of the oxide and hydroxide) are formed, other polyvalent metal ions also can be used provided that their salts are nontoxic and are soluble in the aqueous phase of the system at the desired pH level. Thus, depending on such factors as the the nature of the primary surfactants and cosurfactant, and so on, as well as the availability and cost factors, other suitable polyvalent metal ions include aluminum, copper, nickel, iron, calcium, etc. can be employed. It should be noted, for example, that with the preferred paraffin sulfonate anionic detergent calcium salts will precipitate and should not be used. It has also been found that the aluminum salts work best at pH below 5 or when a low level, for example about 1 weight percent, of citric acid is added to the composition which is designed to have a neutral pH. Alternatively, the aluminum salt can be directly added as the citrate in such case. As the salt, the same general classes of anions as mentioned for the magnesium salts can be used, such as halide (e.g., bromide, chloride), sulfate, nitrate, hydroxide, oxide, acetate, propionate, etc.

Preferably, in the dilute compositions the metal compound is added to the composition in an amount sufficient to provide at least a stoichiometric equivalent between the anionic surfactant and the multivalent metal cation. For example, for each gram-ion of Mg++ there will be 2 gram moles of paraffin sulfonate, alkylbenzene sulfonate, etc., while for each gram-ion of $Al^{3+}$ there will be 3 gram moles of anionic surfactant. Thus, the proportion of the multivalent salt generally will be selected so that one equivalent of compound will neutralize from 0.1 to 1.5 equivalents, preferably 0.9 to 1.4 equivalents, of the acid form of the anionic detergent. At higher concentrations of anionic detergent, the amount of multivalent salt will be in range of 0.5 to 1 equivalents per equivalent of anionic detergent. The concentration of the magnesium sulfate is 0 to 4%, more preferably 0.1 to 2% by weight.

The light duty liquid microemulsion composition of this invention may, if desired, also contain other components either to provide additional effect or to make the product more attractive to the consumer. The following are mentioned by way of example: Colors or dyes in amounts up to 0.5% by weight; bactericides in amounts up to 1% by weight; preservatives or antioxidizing agents, such as formalin, 5-chloro-2-methyl-4-isothaliazolin-3-one, 2,6-di-ter-t.butyl-p-cresol, etc., in amounts up to 2% by weight; and pH adjusting agents, such as sulfuric acid or sodium hydroxide, as needed.

Because the compositions as prepared are aqueous liquid formulations and since no particular mixing is required to form the o/w microemulsion, the compositions are easily prepared simply by combining all the ingredients in a suitable vessel or container. The order of mixing the ingredients is not particularly important and generally the various ingredients can be added sequentially or all at once or in the form of aqueous solutions of each or all of the primary detergents and cosurfactants can be separately prepared and combined with each other and with the perfume. The magnesium salt, or other multivalent metal compound, when present, can be added as an aqueous solution thereof or can be added directly. It is not necessary to use elevated temperatures in the formation step and room temperature is sufficient.

The following examples illustrate liquid cleaning compositions of the described invention. Unless otherwise specified, all percentages are by weight. The exemplified compositions are illustrative only and do not limit the scope of the invention. Unless otherwise specified, the proportions in the examples and elsewhere in the specification are by weight.

EXAMPLE 1

The following compositions in wt. % were prepared:

| | A | B | C | D | E | F | G | H | I | J | K |
|---|---|---|---|---|---|---|---|---|---|---|---|
| Sodium $C_{13}$–$C_{17}$ secondary alkane sulfonate | 7.5 | | 11 | | 17.6 | 7.5 | 20.1 | 12.5 | 18.9 | 9.9 | 21.4 |
| Sodium $C_{12}$–$C_{14}$ alkyl polyethenoxy ether sulfate (2EO) | 2.5 | 1.25 | 2.5 | 11.3 | 5.9 | 2.5 | 6.7 | 4.2 | 6.3 | 3.3 | 7.1 |
| Biodet Type D | | | | | | | 3 | 10.5 | 4.5 | 13.5 | 1.5 |
| Eucarol APG/ET (Tartaric ester of APG) | | | | | | | | | | | |
| Eucarol APG/EC (citric ester of APG) | | | | | | | | | | | |

-continued

| | | | | | | | | | | | |
|---|---|---|---|---|---|---|---|---|---|---|---|
| Eucarol APG/SS (sulfosuccinate of APG) | 19.5 | 10.5 | 10.5 | 10.5 | 4.5 | 16.5 | | | | | |
| Betaine | | 12.2 | | 2.25 | | | | | | | |
| D-Limonene | 6 | 6 | 6 | 6 | | | 6 | 6 | 6 | 6 | 6 |
| L-Terpineol | | | | | 6 | 6 | | | | | |
| Propylene glycol | | | | | | | 5 | 10 | | | |
| Glycerol | 5 | | | | | | | | | | 5 |
| Dipropylene mono methyl ether | | 5 | 5 | 5 | 10 | 10 | | | 5 | 10 | |
| Light transmission % | >98 | >98 | >98 | >98 | >98 | >98 | >98 | >98 | >98 | >98 | >98 |
| Brookfield viscosity, 25° C., #2 spindle, 30 rpms | 100 | 150 | 125 | 125 | 100 | 75 | 125 | 75 | 150 | 100 | 100 |

| | L | M | N | O | P | Q | R | S | T | U | V | W |
|---|---|---|---|---|---|---|---|---|---|---|---|---|
| Sodium $C_{13}$–$C_{17}$ secondary alkane sulfonate | 18.9 | 15 | 20.1 | 20.1 | 20.1 | 13.8 | 8.5 | 16 | 12.3 | | | |
| Sodium $C_{12}$–$C_{14}$ alkyl poly-ethenoxy ether sulfate (2EO) Biodet Type D | 6.3 | 5 | 6.7 | 6.7 | 6.7 | 4.6 | 3.75 | 5 | 7.5 | 5 | 17.5 | 7.5 |
| Eucarol APG/ET (Tartaric ester of APG) | 3 | 7.5 | 1.5 | | | | | | | | | |
| Eucarol APG/EC (citric ester of APG) | | | | 3 | 1.5 | | | | | | | |
| Eucarol APG/SS (sulfosuccinate of APG) | | | | | | 9 | 12 | 1.5 | 3 | 1.5 | | 12 |
| Betaine | | | | | | | | | | 16 | 3.5 | 4.75 |
| D-Limonene | 6 | 6 | 6 | 6 | 6 | 6 | 6 | 6 | 6 | 6 | 6 | 6 |
| L-Terpineol | | | | | | | | | | | | |
| Propylene glycol | 10 | | | 5 | | | | | | | | |
| Glycerol | | | 10 | | 10 | | | | | | | |
| Dipropylene mono methyl ether | | 10 | | | | 10 | 5 | 5 | 5 | 5 | 5 | 5 |
| Light transmission % | >98 | >98 | >98 | >98 | >98 | >98 | >98 | >98 | >98 | >98 | >98 | >98 |
| Brookfield viscosity, 25° C., #2 spindle, 30 rpms | 100 | 100 | 150 | 100 | 125 | 75 | 100 | 100 | 100 | 100 | 100 | 100 |

In summary, the described invention broadly relates to an improvement in a light duty liquid microemulsion composition containing a mixture of a $C_{13}$–$C_{17}$ secondary alkane sulfonate surfactant and an alkyl polyethenoxy ether sulfate surfactant, a biodegradable anionic surfactant, optionally a betaine surfactant, one of the specified cosurfactants, a hydrocarbon ingredient and water to form a microemulsion light duty liquid composition.

What is claimed:

1. A light duty liquid microemulsion composition consisting essentially of approximately by weight: 10% to 34% of a mixture of a sulfonate surfactant and an alkyl ether polyethyenoxy sulfate surfactaant; 0 to 25% of a zwitterionic surfactant, 1% to 10% of a biodegradable anionic surfactant selected from the group consisting of an alkyl ethoxy citrate and a alkyl polyglucoside; 0.4% to 8.0% of a water insoluble hydrocarbon, essential oil or perfume; 0 to 25% of a cosurfactant, and the balance being water, wherein said alkyl polyglycoside is depicted by the formula

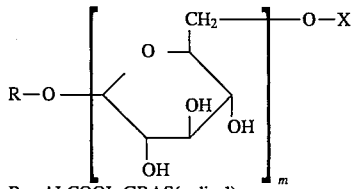

R = ALCOOL GRAS(radical)

wherein R is a $C_{10}$ to $C_{16}$ alkyl group, m is a number average which is less than 4 and is of such a value to provide a number molecular weight of about 500 to 1000, and X is selected from the group consisting of

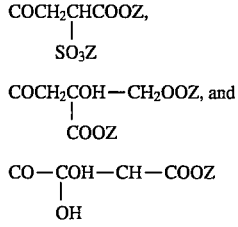

wherein Z is selected from the group consisting of sodium, potassium, ammonium, triethanol amine, diethanoi amine and monoethanol amine, and said light duty liquid microemulsion composition has a light transmission of at least 95%.

2. A light duty liquid microemulsion composition according to claim 1, wherein said sulfonate surfactant and said alkyl ether polyethenoxy sulfate are in a ratio of about 1.2:1 to about 14:1.

3. The cleaning composition of claim 2 which further contains a salt of a multivalent metal cation in an amount sufficient to provide from 0.5 to 1.5 equivalents of said cation per equivalent of said anionic detergent.

4. The cleaning composition of claim 3 wherein the multivalent metal cation is magnesium or aluminum.

5. The cleaning composition of claim 3, wherein said composition contains 0.9 to 1.4 equivalents of said cation per equivalent of anionic detergent.

6. The cleaning composition of claim 4 wherein said multivalent salt is magnesium sulfate.

7. The cleaning composition of claim 2 which contains from about 0.5–15% to about 7% by weight of said cosurfactant and from about 0.4% to about 8.0% by weight of said hydrocarbon.

8. The cleaning composition of claim 2 wherein the cosurfactant is a water soluble glycol ether.

9. The cleaning composition of claim 8 wherein the glycol ether is selected from the group consisting of ethylene glycol monobutylether, diethylene glycol monobutyl ether, triethylene glycol monobutylether, poly-propylene glycol having an average molecular weight of from about 200 to 1,000 and propylene glycol tert.butyl ether, mono, di or tri propylene glycol monobutyl ether.

10. The cleaning composition of claim 9 wherein the glycol ether is ethylene glycol monobutyl ether or diethylene glycol monobutyl ether.

11. The cleaning composition of claim 2 wherein the anionic surfactant is selected from the group consisting of a $C_9$–$C_{15}$ alkyl benzene sulfonate surfactant or a $C_{10}$–$C_{20}$ secondary alkane sulfonate surfactant.

* * * * *